US006428860B1

(12) United States Patent
Szalony

(10) Patent No.: US 6,428,860 B1
(45) Date of Patent: Aug. 6, 2002

(54) METHOD FOR MANUFACTURING MAGNETO-RHEOLOGICAL OR ELECTRO-RHEOLOGICAL SUBSTANCE-IMPREGNATED MATERIALS

(75) Inventor: Norman Szalony, Brighton, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/853,817

(22) Filed: May 11, 2001

(51) Int. Cl.[7] ..... B05D 1/04

(52) U.S. Cl. ..... 427/458; 427/128; 427/132; 427/181; 427/230; 427/294; 427/350; 427/443.2; 427/547; 427/598

(58) Field of Search ..... 427/458, 128, 427/132, 181, 230, 294, 350, 443.2, 547, 598

(56) References Cited

U.S. PATENT DOCUMENTS

| | | | | |
|---|---|---|---|---|
| 2,575,360 | A | 11/1951 | Rabinow | 192/21.5 |
| 2,661,825 | A | 12/1953 | Winslow | 192/21.5 |
| 2,886,151 | A | 5/1959 | Winslow | 192/21.05 |
| 5,398,917 | A | 3/1995 | Carlson et al. | 267/140.14 |
| 5,645,752 | A | 7/1997 | Weiss et al. | 252/62.54 |
| 5,670,213 | A | 9/1997 | Blair | 427/318 |
| 5,779,013 | A | 7/1998 | Bansbach | 192/21.5 |
| 5,823,309 | A | 10/1998 | Gopalswamy et al. | 192/21.5 |
| 5,845,752 | A | 12/1998 | Gopalswamy et al. | 192/21.5 |
| 5,967,273 | A | 10/1999 | Hampton | 192/21.5 |
| 5,985,168 | A | 11/1999 | Phule | 252/52 |

OTHER PUBLICATIONS

Article entitled, "Magnetorheological Fluids: Materials, Characterization, and Devices," by Osama Ashour and Craig A. Rogers, 1996, pp. 123–130, (No month avail.).

Article entitled, "Brakes and Clutches Using ER Fluids," by Chris A. Papadopoulos, Apr. 15, 1998, pp. 719–726.

Article entitled, "Compensator–Based Position Control of an Electrorheological Actuator," by Z.B. Dlodle and D.J. Brookfield, 1999, pp. 895–917. (No month avail).

Article entitled, "Magnetorheological Fluid Based Torque Transmission Clutches," by Melek Yalcintas, 1999, pp. 563–569 (No Month Avail.).

Article entitled, "Design Analysis and Experimental Evaluation of an MR Fluid Clutch," by Usob Lee, Dohyun Kim, Nahmkeon Hur and Doyoung Jeon, 2000, pp. 701–707.

Copy of claims for co–pending U.S. Application Serial No. 09/752,420, filed on Dec. 29, 2000.

*Primary Examiner*—Bernard Pianalto
(74) *Attorney, Agent, or Firm*—Brinks Hofer Gilson & Lione

(57) ABSTRACT

A method for impregnating a porous surface with a magneto-rheological substance includes the steps of providing a porous surface with a porosity sufficient to receive the magneto-rheological substance within the pores and covering a portion of one side of the porous surface with the magneto-rheological substance. The method further includes the step of providing a magnet on the opposite side of the porous surface to apply a magnetic field and draw the magneto-rheological substance into the porous surface.

24 Claims, 3 Drawing Sheets

METHOD FOR MANUFACTURING MAGNETO-RHEOLOGICAL OR ELECTRO-RHEOLOGICAL SUBSTANCE-IMPREGNATED MATERIALS

FIELD OF THE INVENTION

The invention relates generally to the field of magneto-rheological (MR) and electro-rheological (ER) substances, specifically methods for impregnating materials with MR and ER substances.

DESCRIPTION OF THE RELATED ART

ER and MR fluids and powders are substances that rely on a magnetic to capable media compounded in a way that allows the substance to change form from a liquid or powder state to a rigid, solid state. These materials comprise micron-sized, magnetizable particles called fines, suspended in oil or other media. ER and MR powders consist solely of unsuspended magnetizable particles.

ER and MR fluids are similar in their operation. The main difference is that ER fluids are responsive to an electric field and MR fluids are reactive to a magnetic field. However, MR fluids do have some advantages over ER fluids.

In their liquid form, ER and MR fluids have a viscosity and consistency much like common motor oil. However, when an electric charge or magnetic field is applied, the fluids change form, becoming rigid and able to bond surfaces together. This rigid bonding mechanism results from a dipole moment introduced on the magnetic particles in the fluid from the electric charge or magnetic field. The particles form chains, aligning parallel to the electric charge or magnetic field. The strength of the bonding mechanism depends on the strength of the charge or field applied to the fluid and the size of the particles. The change in viscosity of the fluid takes place in a few milliseconds. ER and MR powders operate in the same manner, changing from a powder to a rigid form. MR fluids typically exhibit much stronger yield strengths than do ER fluids. MR fluids are also more resistant to temperature changes and have a high tolerance to impurities such as water. MR fluids can also be activated using a much lower voltage power supply. ER fluids require high voltage (near 5,000 volts) to operate. For purposes of the present disclosure, discussion herein of the terms "ER and/or MR fluids" is also meant to refer to equivalent ER or MR substances, such as powders.

It is desirable to impregnate powder metal parts, which have porous surfaces, with both ER and MR substances. This impregnation increases the efficiency of the ER and MR substances when they are used to bind the parts together in various mechanisms.

BRIEF SUMMARY OF THE INVENTION

In one embodiment of the present invention, a method for impregnating a porous surface with a magneto-rheological substance includes the steps of providing a porous surface with a porosity sufficient to receive the magneto-rheological substance within the pores and covering a portion of one side of the porous surface with the magneto-rheological substance. The method further includes the step of providing a magnet on the opposite side of the porous surface to apply a magnetic field and draw the magneto-rheological substance into the porous surface.

In a second embodiment of the present invention, a method for impregnating a porous film with a magneto-rheological substance includes the steps of providing a porous film with a porosity sufficient to receive the magneto-rheological substance within the pores and immersing a portion of the film in the magneto-rheological substance. The method further includes the step of providing a magnet on a side of the porous film in order to provide a magnetic field to draw the magneto-rheological substance into the porous film.

In a third embodiment of the present invention, a method for impregnating a porous surface with an electro-rheological substance includes the steps of providing a porous surface with a porosity sufficient to receive the electro-rheological substance within the pores and covering a portion of one side of the porous surface with the electro-rheological substance. The method further includes the step of providing a magnet on the opposite side of the porous surface to apply a magnetic field and draw the electro-rheological substance into the porous surface.

In a fourth embodiment of the present invention, a method for impregnating a porous film with an electro-rheological substance includes the steps of providing a porous film with a porosity sufficient to receive the electro-rheological substance within the pores and immersing a portion of the film in the electro-rheological substance. The method further includes the step of providing a magnet on a side of the porous film in order to provide a magnetic field to draw the electro-rheological substance into the porous film.

DETAILED DESCRIPTION OF THE PREFERRED EMBODIMENTS OF THE INVENTION

Figure 1:
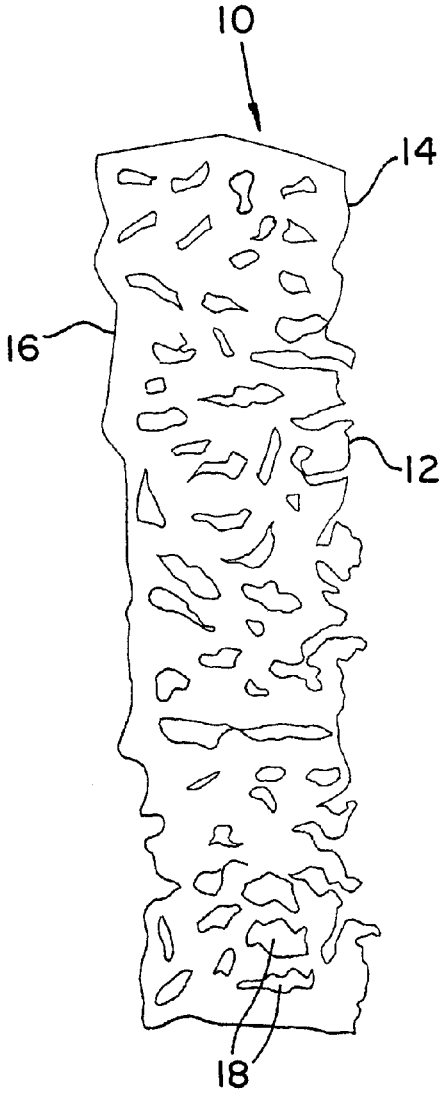
FIG. 1 shows an enlarged view of a cross-section of the structure of a portion of a porous component that may be utilized in accordance with the present method.
Figure 2:
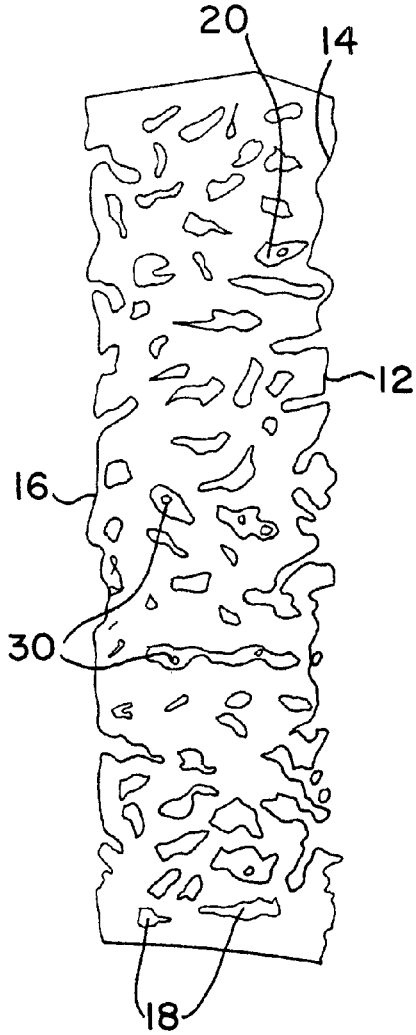
FIG. 2 shows an enlarged view of a cross-section of the structure of the porous component of FIG. 1 after application of the present method.

Referring to FIG. 1, a porous metal component 10 having at least one porous surface 12 is provided for use in the present method. The porous component 10 preferably has a first side 14 and a second side 16. The porous component 10 is preferably substantially flat and preferably made of powder metal. The process of forming a powder metal component is performed by grinding magnetic metal into a fine powder and then pressure molding the powder back into a solid component. This process results in a component 10 having a multitude of pores 18 in its structure and surface. These pores 18 provide spaces for the ER or MR fluid 20 to be retained within the components 10. The component 10 is preferably not so porous that the ER or MR fluid 20 can travel from the first side 14 of the component 10 to the second side 16. An impregnated component 10 is shown in FIG. 2.

Figure 3:
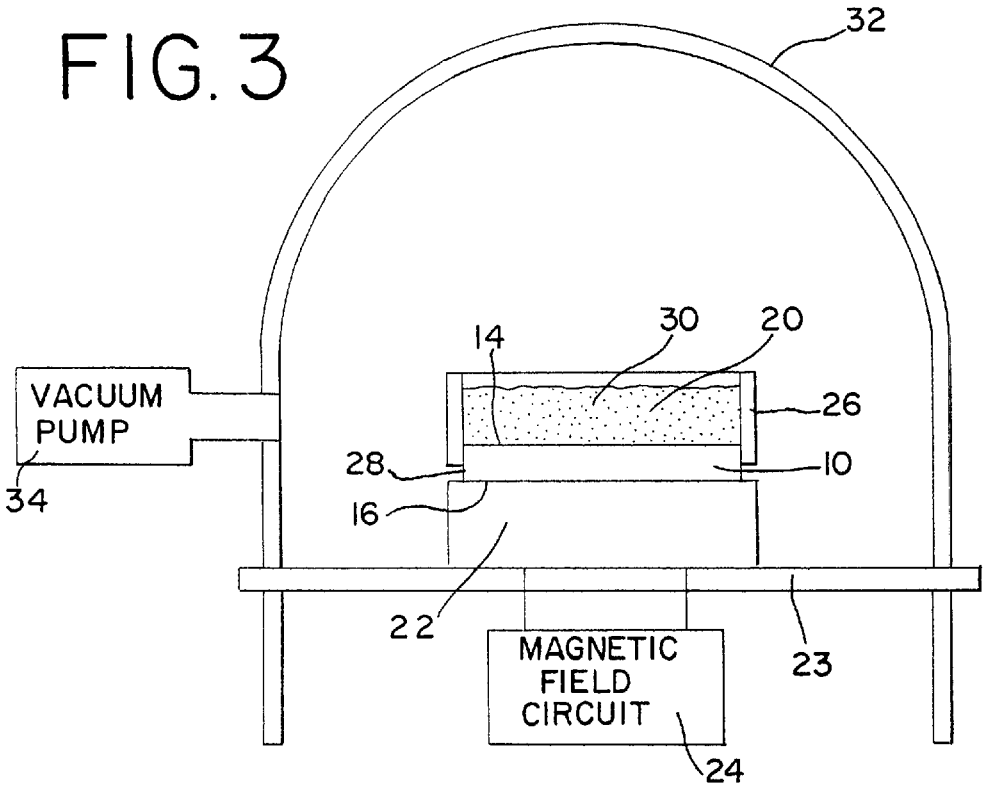
FIG. 3 shows a structure for use in practicing the present method.

Referring to FIG. 3, an example of an embodiment utilizing the present method is shown. An electromagnet 22 is provided, preferably on a working surface 23. The electromagnet 22 is connected as known in the art to a magnetic field circuit 24, shown in schematic form in FIG. 3. The magnetic field circuit 24 allows the electromagnet 22 to be turned off and on, and also preferably controls the power of the magnetic field created by the electromagnet 22 when it is in use.

The electromagnet 22 can take any shape, but it is preferably configured to generally match the contours of the component 10 or section of the component 10 that is being impregnated. The component 10 is preferably placed on the electromagnet 22 such that the second side 16 is in contact with or in close proximity to the electromagnet 22. A tank 26 is also preferably provided. The tank 26 is preferably positioned such that the first side 14 of the component 10 is within the tank 26. The tank 26 preferably provides a seal along the outside edges 28 of the component 10.

An ER or MR substance 20 is provided and preferably placed within the tank 26 such that the first side 14 of the component 10 is covered with the ER or MR substance 20. In the Figures, a fluid 20 is illustrated. If an ER or MR fluid 20 is used, the tank 26 should preferably be substantially impervious to the fluid 20 to minimize leakage.

Preferably, the next step in the preferred method is to supply power to the electromagnet 22 in order to create a magnetic field around the electromagnet 22 and adjacent to the second side 16 of the porous component 10. Since the magnetic fines 30 in the ER or MR fluid 20 are attracted to the electromagnet 22, the electromagnet 22 acts to draw the ER or MR fluid 20 into the pores 18 of the first side 14 of the component 10. The present method can be performed within a vacuum chamber 32 having a vacuum pump 34 to remove excess air from the pores 18 of the component 10 during the impregnation process. This increases the amount of ER or MR fluid 20 that is drawn into the component 10 and improves the efficiency of the method. FIG. 2 shows a component 10 after impregnation, with the ER or MR fluid 20 in place in the pores 18 of the component 10. If desired, the component 10 can then be turned over, or agitated, and the method can be repeated to impregnate the second side 16 of the component 10.

Figure 7:
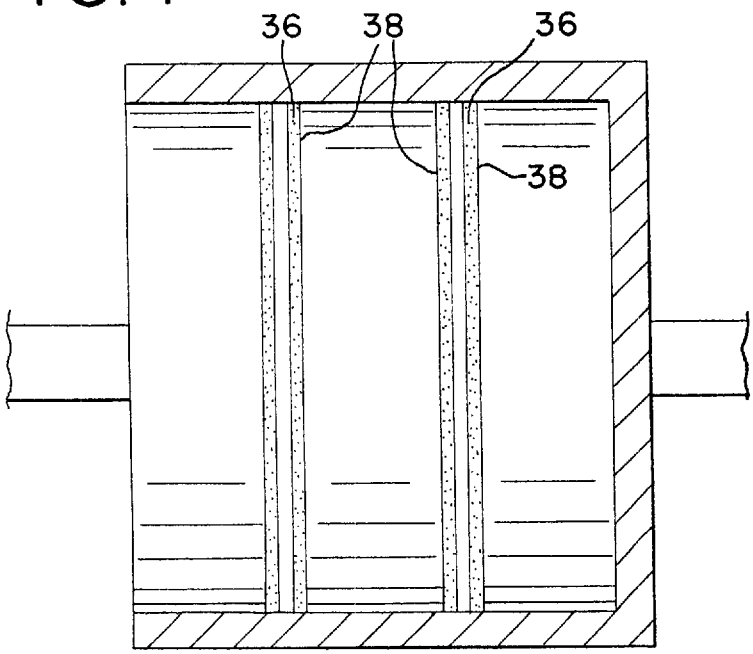
FIG. 7 shows a side view of components with a porous film impregnated utilizing the present method attached thereto.

In another embodiment of the present invention, a porous film 36 is impregnated instead of porous component 10. This embodiment allows the impregnation of any amount of a porous film 36. The porous film 36 may be made out of any porous material such as a fibrous mat or sisal. The film 36 is preferably substantially thin and flexible, allowing it to easily roll up and to conform to the shape of any component. Since the film 36 is preferably substantially thin, it can be attached to a component 10 without adding much thickness. After impregnation, the porous film 36 may be cut to any size or shape, and attached to the surface 38 of a component 10 of any kind as shown in FIG. 7. It is also possible to attach the porous film 36 to the component 10 before impregnation, and utilize the method described above in reference to FIG. 3 to impregnate the film 36. This embodiment of the method provides flexibility to use the bonding capabilities of ER or MR fluid on any size or shape of component 10. For example, it would not be cost-effective to construct an electromagnet 22 of an extremely large size. Rather, a film 36 could be impregnated with ER or MR fluid 20, and strips of the film 36 could be cut and attached to the surface of the large component to completely cover it.

In this embodiment of the method, an electromagnet 22 is preferably provided and is attached to a magnetic field circuit 24 to supply power to the electromagnet 22 and create the magnetic field. A retainer 40 is preferably positioned on top of the electromagnet 22. The retainer 40 is preferably filled with ER or MR fluid 20. A spool 42 of the porous film 36 is preferably placed on a first roller 44 on one side of the retainer 40. On the other side of the retainer 40, a second roller 46 is provided to hold the porous film 36 after impregnation. The rollers 44, 46 are preferably motorized so that they are able to unroll the porous film 36 in a continuous sheet and move it through the retainer 40.

Preferably, the electromagnet 22 is turned on to provide a magnetic field and the rollers 44, 46 unroll the porous film 36. The porous film 36 enters the retainer 40 and is preferably immersed in the ER or MR fluid 20.

The magnetic field draws the ER or MR fluid 20 into the pores of the porous film 36 while the porous film 36 passes though the retainer 40. The porous film 36 continues out of the retainer 40 and is collected on the second roller 46.

Figure 5:
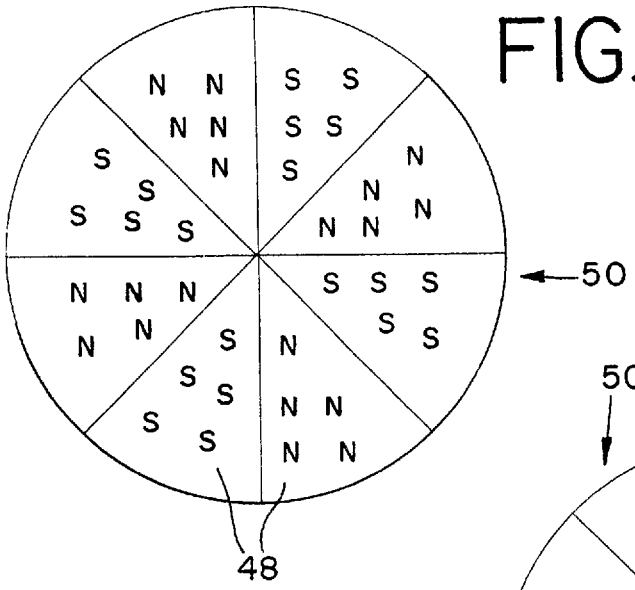
FIG. 5 shows an example of the polarities of sections of a component after application of the present method.
Figure 6:
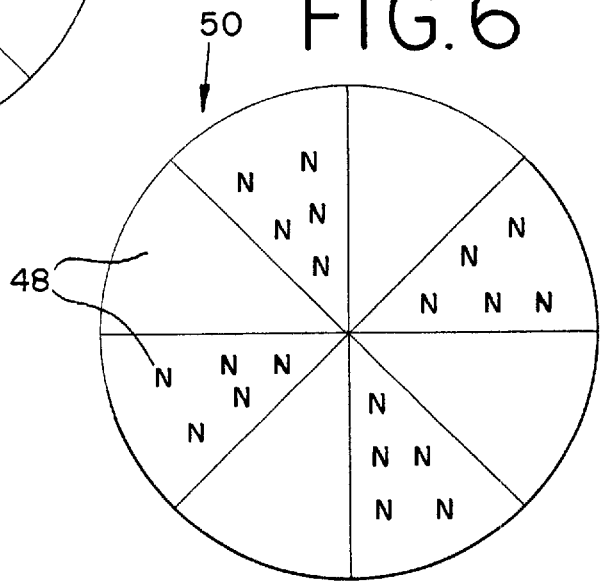
FIG. 6 shows an alternative example of the polarities of sections of a component after application of the present method.

All embodiments of the method can be adjusted to provide areas of differing polarity on the impregnated component 10 or porous film 36. FIGS. 5 and 6 show some possible polarity arrangements. In FIG. 5, each section 48 of a round component 50 is impregnated with an ER or MR substance. The sections 48 alternate between North and South polarities. In order to accomplish this arrangement, the method described previously can be utilized, and the polarity of the electromagnet 22 should be adjusted depending on the section 48 being impregnated. The electromagnet 22 is preferably shaped to match the desired shape of the section 48 to impregnated. For example, to create polarized sections 48 as shown in FIGS. 5 and 6, the electromagnet 22 should be wedge-shaped and substantially mirror the size of each section 48. It is also possible to apply the ER or MR substance only to the section 48 being impregnated. Since the ER or MR fluid 20 is drawn into the component 50 by its attraction to the opposing magnetic field of the electromagnet 22, the polarity of each section 48 on the first side 14 will be the same as the polarity of the electromagnet 22 used to draw the ER or MR fluid into the section 48. The same concept can be used to adjust areas of polarity on the porous film 36. The differing areas of polarity can then be used to provide a cheap, efficient sensor means. A sensor could be positioned opposite a moving part that has been impregnated with differing sections 48 of polarity. As the part moves, the sensor recognizes the polarities and determines the speed, position and other properties of the moving part.

Figure 4:
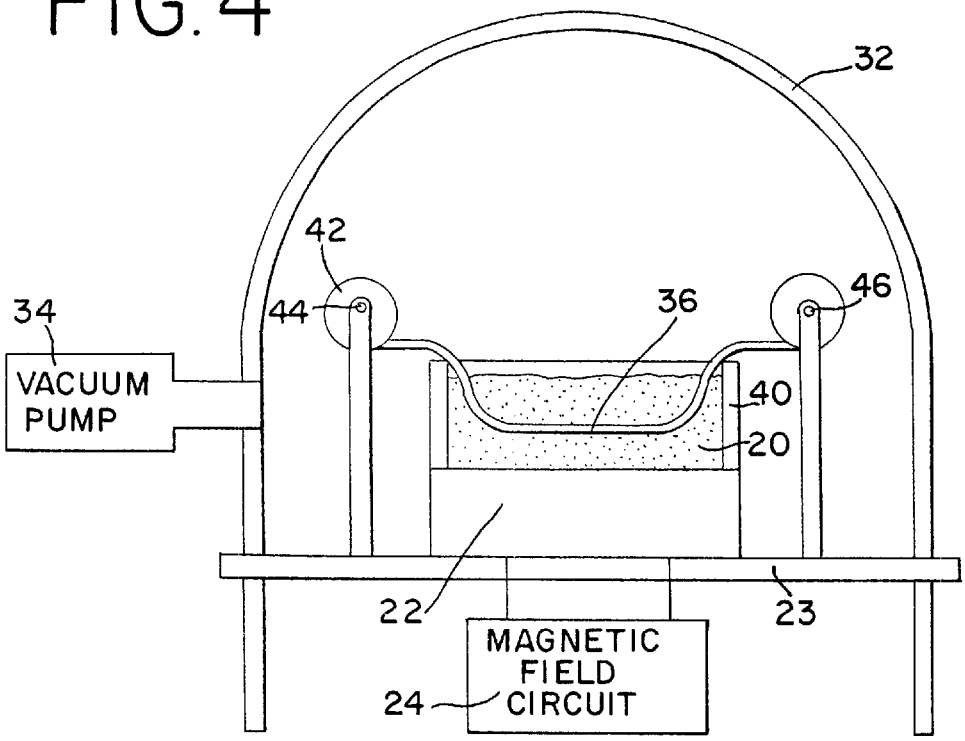
FIG. 4 shows an alternate structure for use in practicing the present method.

It should be noted that there could be a wide range of changes to the claimed method. For instance, ER or MR powder could be used instead of fluid 20. Any porous material could be used for the porous component 10, 50, not necessarily only powder metal. The magnetic field circuit 24 shown in FIGS. 3 and 4 is meant to be illustrative; the actual circuit could have any arrangement, so long as a magnetic field is created. The magnetic field circuit 24 could be removed entirely and a regular magnet could be used to supply the magnetic field. The rollers 44, 46 utilized to move the porous film 36 through the retainer 40 could take any number of forms, or a different method of moving the film 36 through the ER or MR fluid 20 and the retainer 40 could be used. The method could be performed without the aid of the vacuum chamber 32 and vacuum pump 34, and pressure could be applied to the impregnated component 10, 50 to aid in the removal of the air pockets in the pores 18. It is also possible to completely eliminate the tank 26 or retainer 40 and pour the ER or MR fluid directly on to the component 10, 50 or film 36 during the process. Thus, it is intended that the foregoing detailed description be regarded as illustrative rather than limiting and that it be understood that it is the following claims, including all equivalents, which are intended to define the scope of the invention.

What is claimed is:

1. A method of impregnating a porous surface with a magneto-rheological substance, said method comprising the steps of:

providing a porous surface having a porosity sufficient to receive said magneto-rheological substance within a plurality of said pores and having a first side and a second side;

covering at least a portion of said first side of said porous surface with said magneto-rheological substance; and providing a magnet on said second side of said porous surface to apply a magnetic field in order to draw said magneto-rheological substance into said porous surface.

2. The method of claim 1, wherein said magneto-rheological substance is a powder made up of magnetic fines.

3. The method of claim 1, wherein said magneto-rheological substance is made up of magnetic fines suspended in a fluid.

4. The method of claim 3, wherein a powder metal component comprises said porous surface.

5. The method of claim 4, further comprising the step of providing a tank for immersing said component in said magneto-rheological substance.

6. The method of claim 5, further comprising the step of immersing said second side of said surface in said magneto-rheological substance.

7. The method of claim 5, further comprising the step of removing air pockets from said porous surface during the impregnation of said porous surface by placing said magnet and said porous surface in a vacuum chamber.

8. The method of claim 5, further comprising the step of applying pressure to said first side of said porous surface after said magneto-rheological substance is impregnated within said porous surface.

9. The method of claim 5, further comprising the step of changing the polarity of said magnet according to the desired polarity arrangement of said porous surface being impregnated with said magneto-rheological substance.

10. A method of impregnating a porous film with a magneto-rheological substance, said method comprising the steps of:

providing a porous film having a porosity sufficient to receive said magneto-rheological substance within a plurality of said pores;

immersing at least a portion of said porous film in said magneto-rheological substance; and providing a magnet on a side of said porous film in order provide a magnetic field to draw said magneto-rheological substance into said porous film.

11. The method of claim 10, further comprising the step of positioning said magneto-rheological substance within a retainer before impregnation of said porous film.

12. The method of claim 11, further comprising the step of positioning said porous film upon a system of rollers allowing unrolling of said porous film and movement of said porous film into and out of said retainer in a continuous sheet.

13. A method of impregnating a porous surface with an electro-rheological substance, said method comprising the steps of:

providing a porous surface having a porosity sufficient to receive said electro-rheological substance within a plurality of said pores and having a first side and a second side;

covering at least a portion of said first side of said porous surface with said electro-rheological substance; and providing a magnet on said second side of said porous surface to apply a magnetic field in order to draw said electro-rheological substance into said porous surface.

14. The method of claim 13, wherein said electro-rheological substance is a powder made up of magnetic fines.

15. The method of claim 13, wherein said electro-rheological substance is made up of magnetic fines suspended in a fluid.

16. The method of claim 15, wherein a powder metal component comprises said porous surface.

17. The method of claim 16, further comprising the step of providing a tank for immersing said component in said electro-rheological substance.

18. The method of claim 17, further comprising the step of covering said second side of said surface with said electro-rheological substance.

19. The method of claim 17, further comprising the step of removing air pockets from said porous surface during the impregnation of said porous surface by placing said magnet and said porous surface in a vacuum chamber.

20. The method of claim 17, further comprising the step of applying pressure to said first side of said porous surface after said electro-rheological substance is impregnated within said porous surface.

21. The method of claim 17, further comprising the step of changing the polarity of said magnet according to the desired polarity arrangement of said porous surface being impregnated with said electro-rheological substance.

22. A method of impregnating a porous film with an electro-rheological substance, said method comprising the steps of:

providing a porous film having a porosity sufficient to receive said electro-rheological substance within a plurality of said pores;

immersing at least a portion of said porous film in said electro-rheological substance; and providing a magnet on a side of said porous film in order provide a magnetic field to draw said electro-rheological substance into said porous film.

23. The method of claim 22, further comprising the step of positioning said electro-rheological substance within a retainer before impregnation of said porous film.

24. The method of claim 23, further comprising the step of positioning said porous film upon a system of rollers allowing unrolling of said porous film and movement of said porous film into and out of said retainer in a continuous sheet.

* * * * *